US005980818A

United States Patent [19]

McTaggart et al.

[11] Patent Number: 5,980,818

[45] Date of Patent: Nov. 9, 1999

[54] MELT TANK ASSEMBLY

[75] Inventors: Michael Douglas McTaggart; Andrew Noestheden, both of Windsor, Canada

[73] Assignee: Valiant Machine & Tool Inc., Canada

[21] Appl. No.: 09/111,540

[22] Filed: Jul. 8, 1998

[51] Int. Cl.[6] ..... B22D 17/22

[52] U.S. Cl. ..... 266/276; 266/900; 164/345

[58] Field of Search ..... 266/200, 900, 266/276; 164/132, 345; 432/162, 163, 156

[56] References Cited

U.S. PATENT DOCUMENTS

| | | | |
|---|---|---|---|
| 1,914,717 | 6/1933 | Heuer | 266/900 |
| 2,980,412 | 4/1961 | Koerner | 266/276 |
| 3,247,555 | 4/1966 | Keating | 266/276 |
| 4,378,105 | 3/1983 | Zeug | 266/900 |

*Primary Examiner*—Scott Kastler

*Attorney, Agent, or Firm*—Gifford, Krass, Groh, Sprinkle, Anderson & Citkowski, P.C.

[57] ABSTRACT

A melt tank is disclosed having a plurality of cartridges wherein each cartridge is adapted to hold at least one molded part. An annular tank is provided having an open top while a substantially circular plate is coaxially rotatably mounted to the top of the annular tank. The circular plate includes a plurality of circumferentially spaced openings formed around its outer periphery wherein each opening is adapted to slidably receive and support one cartridge. The annular tank is filled with a heated liquid while a motor rotatably drives the plate with the molded parts immersed in the heated liquid. A robotic gantry selectively lifts the cartridges from the circular plate to enable the removal of finished melted out parts as well as the insertion of new molded over parts into the cartridges.

7 Claims, 5 Drawing Sheets

MELT TANK ASSEMBLY

BACKGROUND OF THE INVENTION

I. Field of the Invention

The present invention relates generally to a melt tank for processing molded parts.

II. Description of the Prior Art

In the manufacture of molded parts having internal recesses or passageways, a core is first constructed corresponding in shape to the internal recesses or passageways. This core, furthermore, is constructed of a material having a relatively low melting point. In industrial applications, the core is typically constructed of a metallic composition having a low melting temperature, e.g. 360° F.

After the core is formed, the material forming the part is cast over the core and allowed to harden. In order to complete the molded part after hardening, it is necessary to remove the core material from the internal recesses and passageways of the molded part.

In industrial applications, the molded part with the core material still filling the internal passageways and chambers of the molded part is placed in a pallet and then pallets are loaded in the cartridge which, in turn, is placed in a melt tank. The melt tank is maintained at a temperature sufficiently high to melt the core material from the molded parts. Once melted, the core material evacuates from the internal recesses and passageways of the molded part and is collected at the bottom of the melt tank for subsequent reuse in a molding operation.

These previously known melt tanks have typically comprised rectangular structures having a conveyor system extending around the entire bottom of the melt tank. The cartridges are then placed on the conveyor and then conveyed along the outer periphery of the rectangular tank which, in turn, is filled with a heated liquid. These previously known melt tanks, such as a perimeter roller system, a monorail system and a Bachman system, however, have proven disadvantageous in a number of different respects.

One disadvantage of these previously known melt tanks is that, since the conveyor system is contained within and at the bottom of tank, maintenance on the conveyor system requires that the entire tank be evacuated and cooled before maintenance on the conveyor system can be initiated. This disadvantageously results in excessive downtime for the melt tank especially in the case of a monorail system.

A still further disadvantage of these previously known melt tanks is that, since the cartridges are conveyed in a rectangular pattern, a turning conveyor mechanism is required at each corner of the rectangular tank in order to transfer the cartridges from one side of the conveyor tank to the next adjacent side. These turning mechanisms not only increase the overall cost of the melt tank, but also require periodic maintenance. Such maintenance, in turn, also requires that the melt tank be drained and cooled prior to initiating the maintenance.

A still further disadvantage of these previously known melt tanks is that several separate conveyor mechanisms are required, i.e. one for each side of the rectangular tank.

A still further disadvantage of these previously known systems is that a large volume of the melting liquid is required due to the design of the tank. The melting liquid, i.e. lutron, however, is very expensive.

SUMMARY OF THE PRESENT INVENTION

The present invention provides a melt tank which overcomes all of the above-mentioned disadvantages of the previously known devices.

In brief, the melt tank assembly of the present invention comprises an annular tank having a top. A substantially circular plate is coaxially rotatably mounted about the top of the tank such that the outer perimeter of the plate overlies and covers at least a portion of the top of the tank.

A plurality of circumferentially spaced openings are formed through the plate in registration with the tank. Each opening is adapted to vertically slidably receive one cartridge which, in turn, holds one or more molded parts. A robotic picker assembly selectively engages the cartridges to both lift the cartridges from the circular plate as well as to unload the finished parts and load in new unfinished parts into the cartridges.

In order to rotatably drive the circular plate relative to the annular tank, and thus rotatably move the cartridges with their contained molded parts through the annular tank, a pair of upright supports are positioned at diametrically opposed positions around the annular tank. At least one crossbeam extends between the upright supports and a motor is mounted to the crossbeam. The output shaft of the motor is drivingly connected to the circular plate so that, upon activation of the motor, the circular plate with its attached cartridges are rotatably driven.

In the preferred embodiment, a tilt housing defining a tilt chamber is attached at a preselected circumferential position around the annular tank so that the tilt chamber is fluidly open to the annular tank.

A pusher/puller assembly is associated with the tilt chamber for radially slidably moving a cartridge aligned with the tilt chamber from the annular tank and into a carriage contained within the tilt chamber. Once in the carriage, a motor rotatably drives the carriage to invert the cartridge in order to facilitate draining of the core material from the internal passageways of the molded part. The carriage then returns the cartridge to its upright position and the moving means are again activated to move the cartridge from the tilt chamber back into the annular chamber and so that the cartridge again is supported by the circular plate. Thereafter, the circular plate is rotatably indexed until the next cartridge is aligned with the tilt chamber whereupon the above process is repeated.

A primary advantage of the melt tank assembly of the present invention is that, by using an annular melt tank, the previously known necessity of a turning mechanism at each comer of the rectangular melt tank is completely avoided. Furthermore, since the circular plate is rotatably mounted to the top of the annular tank, at least certain types of maintenance can be performed on the circular plate and its associated components without either draining the annular tank or cooling the annular tank.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
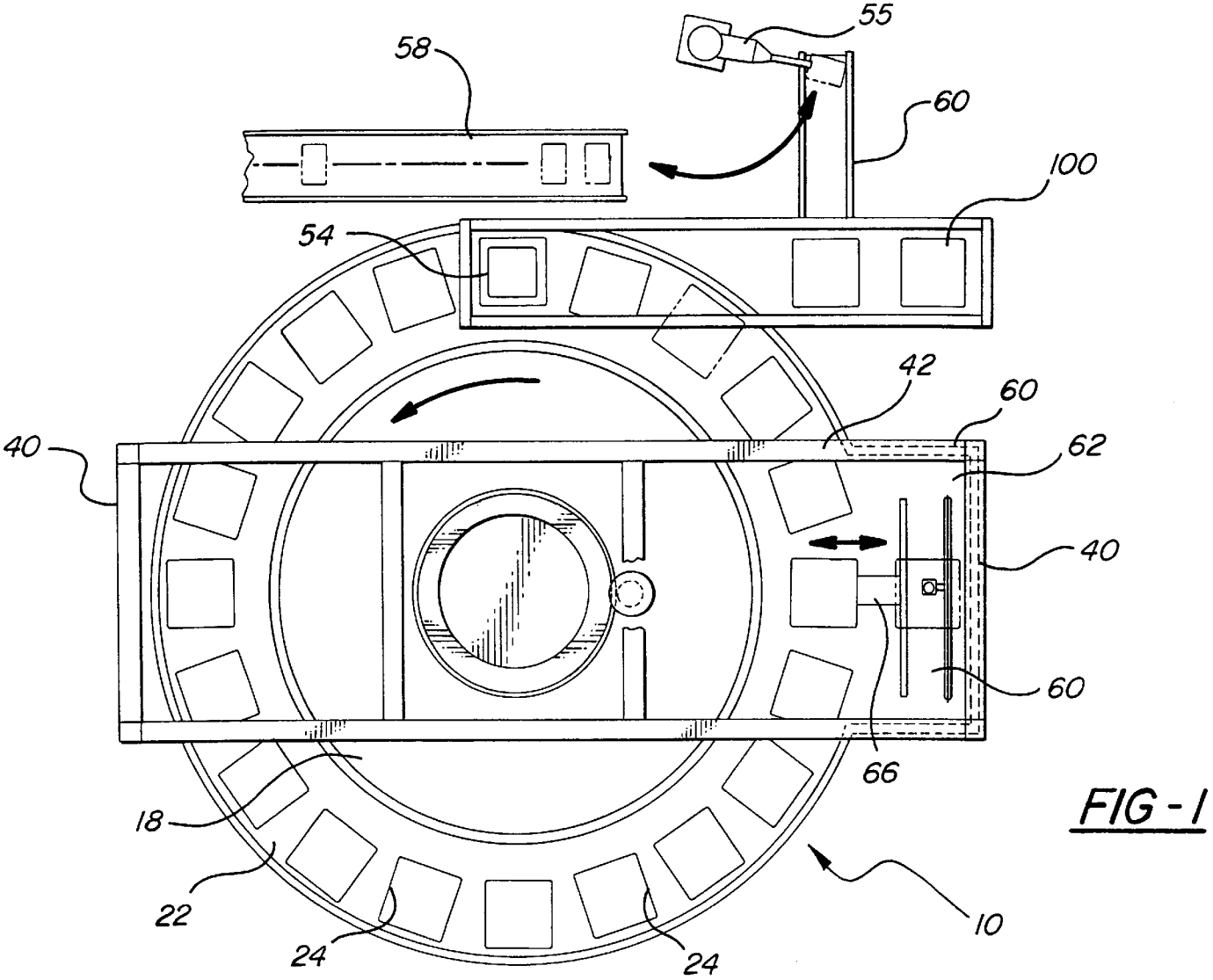
FIG. 1 is a top plan view illustrating a preferred embodiment of the present invention.
Figure 2:
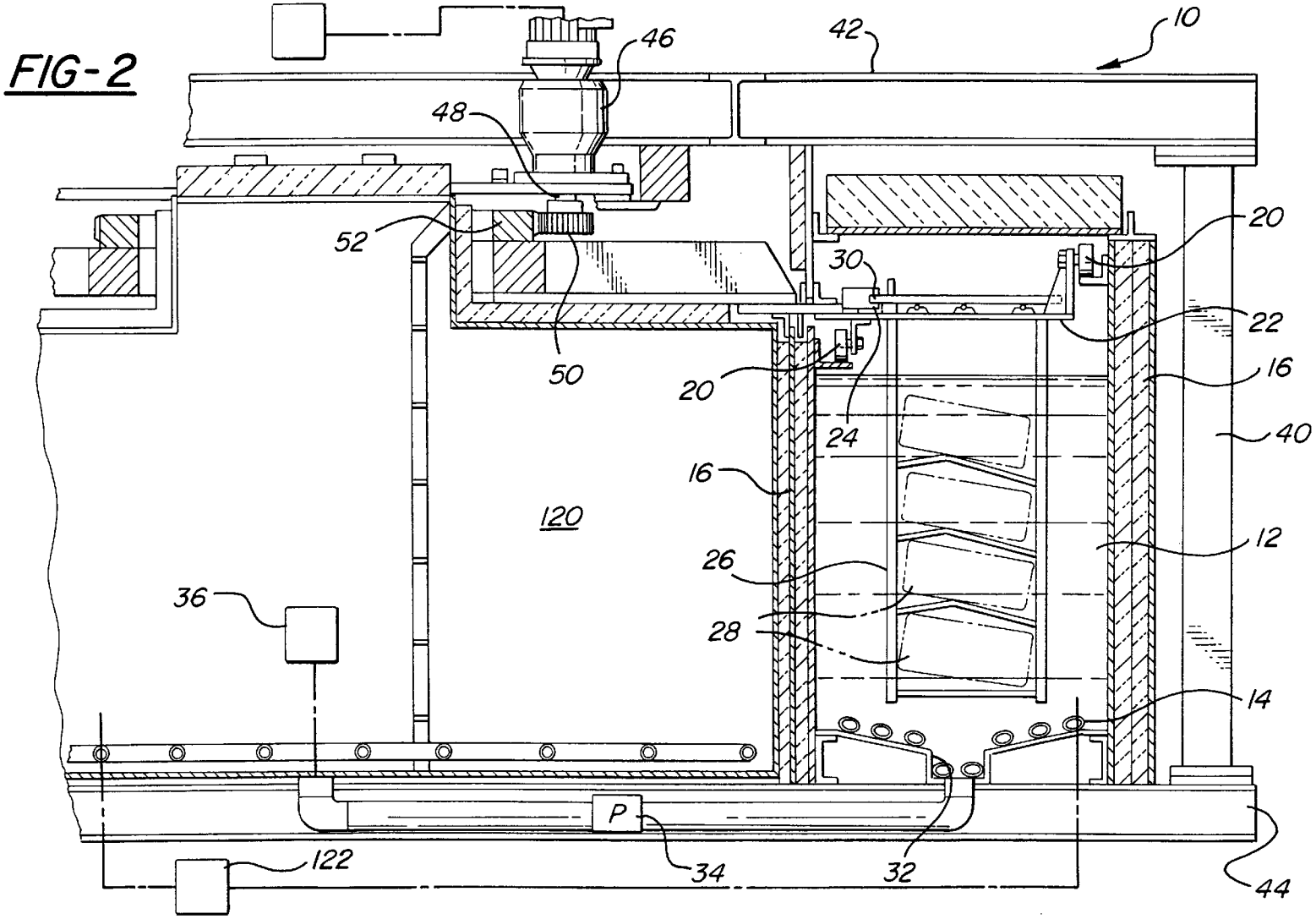
FIG. 2 is a cross-sectional view illustrating a portion of the preferred embodiment of the present invention.

With reference first to FIGS. 1 and 2, a preferred embodiment of the melt tank assembly 10 of the present invention is there shown and comprises an annular tank 12 adapted to hold a hot liquid, such as lutron. Convection heating coils 14 are provided within the annular tank 12 for heating the liquid and thermal insulation 16, such as rock wool, is also provided around the sides of the tank 12. Forced spray heating is also used in conjunction with convection heating.

As best shown in FIG. 1, a central storage tank 120 is provided interiorly of the annular tank 12. A conventional pump 122 (illustrated only diagrammatically), upon activation, pumps the liquid from the annular tank 12 into the storage tank 120 for maintenance purposes and the like. Upon completion of the maintenance, the pump 122 again returns the liquid to the annular tank 12.

Figure 5:
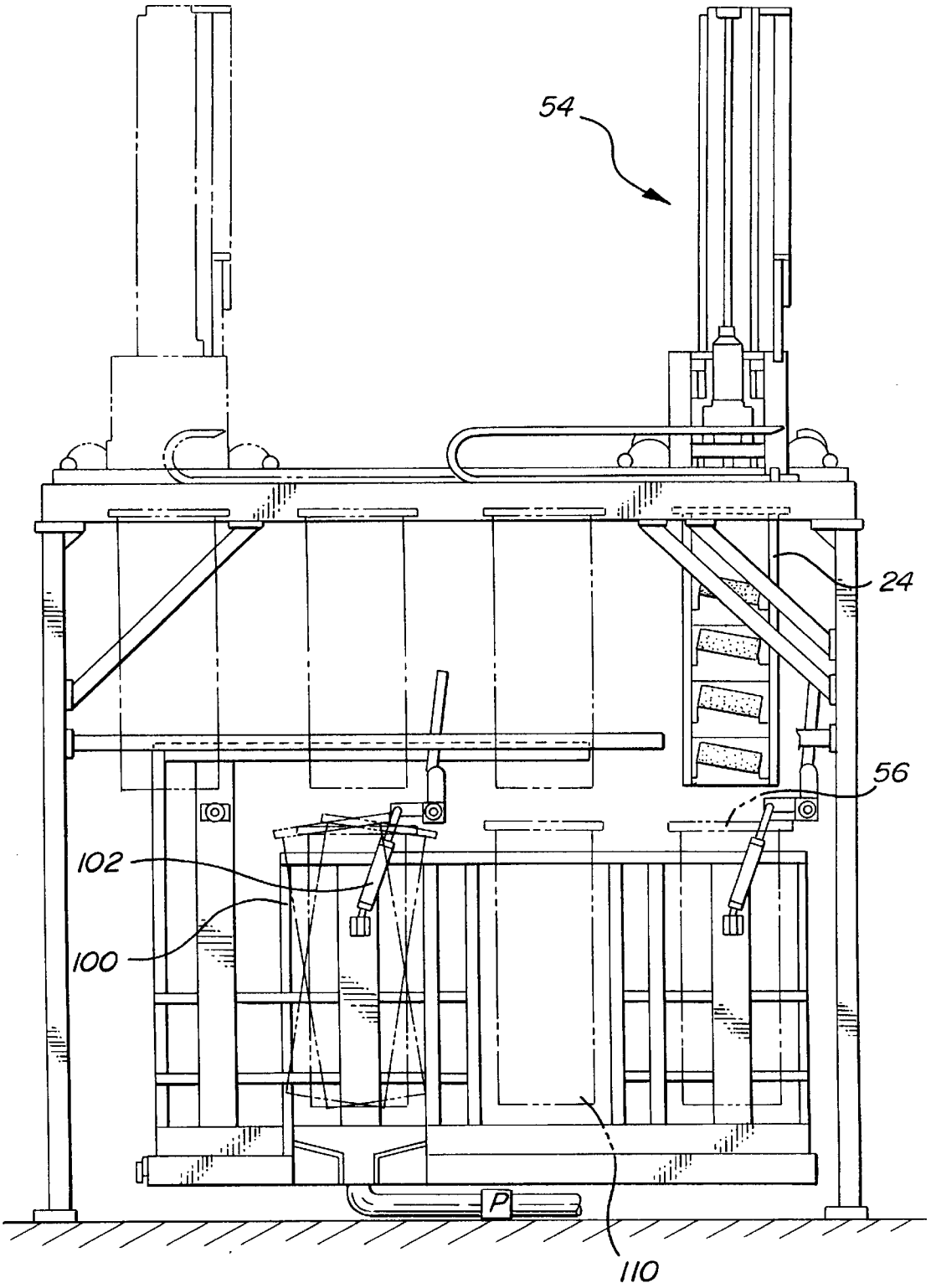
FIG. 5 is a view illustrating the unloading and loading of cartridges into the melt tank assembly in the preferred embodiment of the present invention.

With reference now to FIGS. 1, 2 and 5, a circular plate 18 is rotatably mounted by rollers 20 (FIG. 2) around the top of the annular tank 12 so that at least a portion of an outer perimeter 22 of the plate 18 overlies the annular tank 12.

Figure 4:
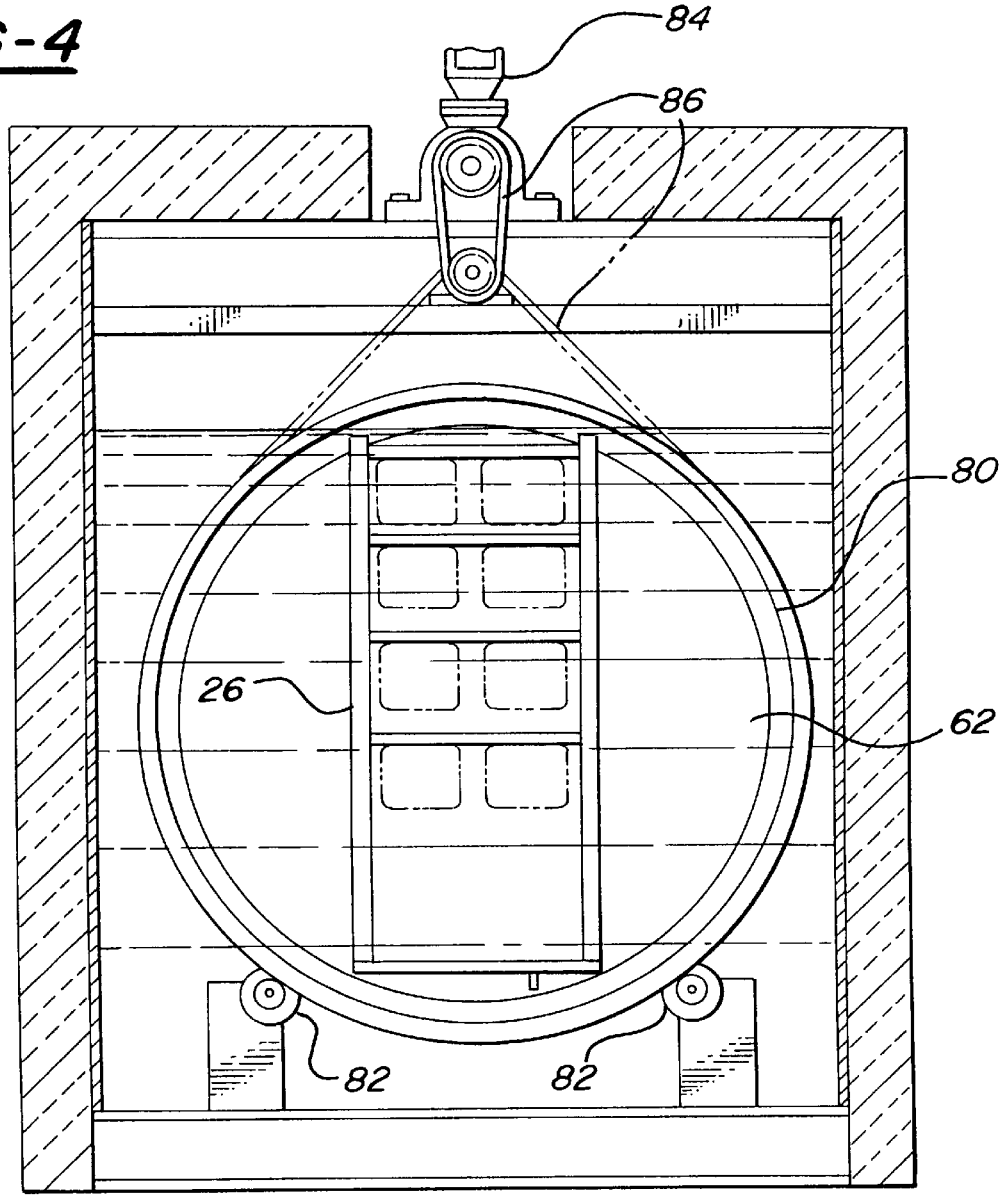
FIG. 4 is a view taken substantially along line 4—4 in FIG. 3.

A plurality of circumferentially spaced openings 24 are provided through the outer perimeter 22 of the circular plate 18. Each opening 24 is adapted to vertically slidably receive and support an elongated cartridge 26 such that the cartridge 26 depends downwardly from the plate 18. Furthermore, as best shown in FIGS. 2 and 4, each cartridge 26 is adapted to receive and support at least one molded part 28 (FIG. 2). As shown in the drawing, eight molded parts 28 are carried by each cartridge 26.

As best shown in FIG. 5, each cartridge 26 includes an upper frame 30 having an outer periphery which overlies the circular plate 18 around its associated opening 24. As such, the cartridges 26 depend downwardly from the circular plate 18 and are supported on the plate 18 by the outer periphery of the frame 30. Furthermore, for a reason to be subsequently described, the cartridges 26 are radially outwardly slidably mounted to the circular plate 18.

With reference now to FIG. 2, a trough 32 extends along the bottom of the tank 12 along its entire length. This trough 32 is used to collect core material melted from the parts 28. This core material is then returned by gravity feed to a pump 34 to a collection area 36 (illustrated only diagrammatically) for reuse in future molding operations.

Referring again to FIGS. 1 and 2, a pair of upright supports 40 are provided outside of the annular tank 12 at diametrically opposed positions. At least one, and preferably several crossbeams 42 extend between the upright supports 40. The uprights 40 are secured to a base 44 and are thus stationary relative to the annular tank 12.

A motor 46 having an output shaft 48 (FIG. 2) is supported by the crossbeams 42 such that the output shaft 48 is drivingly connected to the circular plate 18. As shown in the drawing, a pinion 50 meshingly engages a gear ring 52 mounted to the circular plate 18. A motor control 50 (illustrated only diagrammatically in FIG. 2) selectively controls the activation of the motor 46 to rotatably drive the motor 46 and thus rotatably index the cartridges 26 through the annular tank 12.

With reference now to FIGS. 1 and 5, a robotic gantry 54 (best shown in FIG. 5) selectively engages a cartridge 26 positioned at a preset circumferential position 56 (FIG. 1) of the annular tank 12. The gantry 54 lifts the cartridge 24 out of the tank 12, conveys the cartridge to a drain station 100 and then lowers the cartridge into the drain station 100. Means 102 (FIG. 5) at the drain station agitate the cartridge thus further expelling core material from the parts. The expelled core material is collected by means 104 and returned to the tank 12.

After placing the cartridge 24 into the drain station, and while the agitating means 102 is activated, the gantry 54 moves to a steam station 110 adjacent the drain station. The gantry then elevates the cartridge in the steam station sequentially in vertical increments which allows a robotic picker 55 (FIG. 1) to unload finished parts onto an exit conveyor 58 and reload new parts to be processed. The gantry 54 then places the newly loaded cartridge 26 into the tank 12, moves the cartridge from the drain station 100 to the steam station 110 and then repeats the above process. Steam is applied to the parts in the cartridge at the steam station 110 in order to further clean them.

Figure 3:
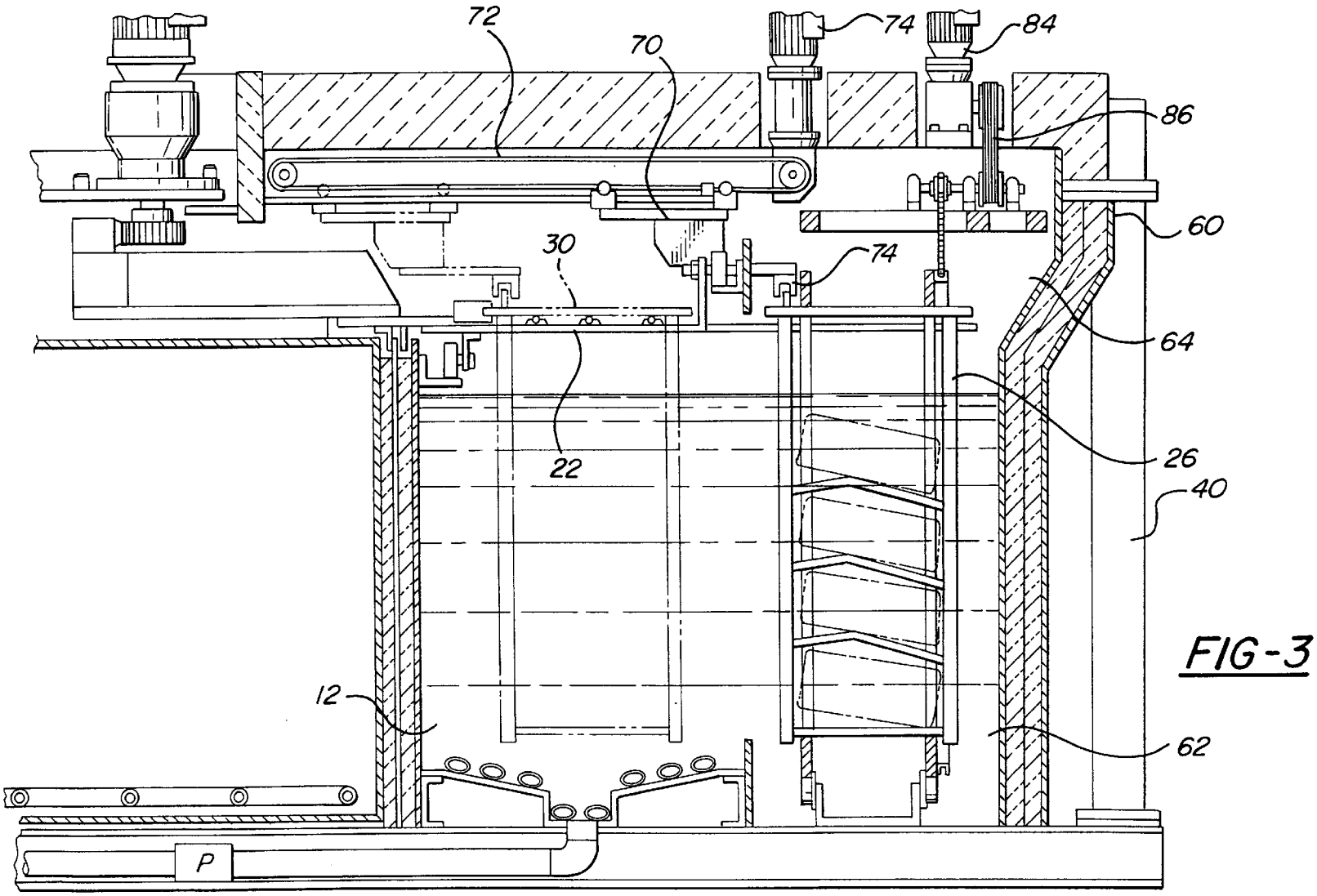
FIG. 3 is a cross-sectional view of a portion of a preferred embodiment of the present invention.

With reference now to FIGS. 1 and 3, a tilt housing 60 defining a tilt chamber 62 is provided at a preselected circumferential position around the annular tank 12 such that the annular tank 12 and tilt chamber 62 are fluidly open to each other. A generally rectangular plate 64 substantially covers the top of the tilt chamber 62. This plate 64, however, includes a radially extending slot 66 (FIG. 1) which registers with the outer periphery of the circular plate 22. Furthermore, the width of the slot 66 is less than the cartridge frame member 30 such that the cartridge 26 can be radially slid between the annular tank 12, as shown in phantom line in FIG. 3, and the tilt chamber 62, as shown in solid line in FIG. 3.

Any conventional means can be used to radially displace the cartridge 26 from the annular tank 12 and tilt chamber 62. However, as shown in FIG. 3, a pusher assembly 70 is secured to a radially extending endless chain 72. The chain 72, in turn, is selectively driven in both a forward and reverse direction by a motor 74. When the cartridge 26 is positioned in radial alignment with the tilt chamber 62, a portion 74 of the pusher assembly 70 engages the cartridge 26. Thereafter, activation of the motor 70 in a first direction drives the cartridge 26 radially outwardly from the annular tank 12 and into the tilt chamber 62. Subsequent activation of the motor 74 in the opposite direction returns the cartridge 26 from the tilt chamber 62 to the annular tank 12.

With reference now to FIGS. 3 and 4, a circular carriage assembly 80 is rotatably mounted on rollers 82 within the tilt chamber 62. Mis carriage assembly 80, furthermore, is designed to receive and support one cartridge 26 as the cartridge 26 is moved from the annular tank 12 and into the tilt chamber 62. Once the cartridge 26 is positioned within the carriage assembly 80, a motor 84 is activated which, through drive belts 86, rotatably drive the carriage assembly 80 with its contained cartridge 26.

Consequently, activation of the motor 84 with the cartridge 26 positioned within the carriage assembly 80 causes the carriage assembly 80 to invert the cartridge 26 and then subsequently return the cartridge 26 to an upright position. In doing so, liquid core material contained within the interior passageways and recesses of the molded part pour outwardly from the molded part in order to ensure complete emptying of the core material from the molded part. In practice, the motor 84 completely rotates the cartridge 26 one or more times.

Following rotation of the cartridge 26 by the carriage assembly 80, the motor 74 is activated in the reverse direction such that the pusher assembly 70 pulls the cartridge 26 back into the annular tank 12. The motor 46 (FIG. 2) is then activated to index the circular plate until the next cartridge 26 is aligned with the tilt chamber 62 whereupon the above process is repeated.

Although the operation of the melt tank of the present invention should by now be apparent, it will be summarized in the interest of clarity.

The annular tank 12 is first filled with a liquid, such as lutron, having a boiling point higher than the melting point of the core material. The gantry 54 and robotic picker assembly 55 selectively fills sequential cartridges with parts and then loads the sequential cartridges into the receiving opening on the circular plate as has been previously described. After the cartridge is loaded into the circular plate, the motor 46 is indexed to bring the next cartridge into position relative to the gantry which selectively moves the parts between the tank, drain station 100 and steam station 110.

As the parts 28 are rotatably driven through the annular tank 12 by the motor 46, the core material melts from the parts and flows outwardly into the annular tank 12. Since the core material is typically a metal composite and thus heavier than the liquid in the annular tank, the core material is collected in the trough 32 and recycled for further use.

For complex molded parts, simply melting the core material within the molded part is oftentimes insufficient to completely drain the core material from the parts. However, as the cartridges sequentially align with the tilt chamber 62 as the circular plate is rotatably indexed, rotation of the cartridge within the tilt chamber with its contained parts effectively empties the core material that may be entrapped within the part.

Following removal of the finished parts from the melt tank, the parts may be further washed by means not shown and then conveyed away from the melt tank.

A primary advantage of the present invention is the provision of the circular plate for rotatably supporting the cartridges about the top of the annular tank. This drive mechanism for the cartridges thus completely eliminates the previously known transfer mechanisms required in the previously known rectangular melt tanks.

A still further advantage of the present invention is that, due to the circular tank design, a high ratio of the metal alloy to the volume of lutron is maintained. In view of the high cost of lutron, this design minimizes the lutron costs as compared to prior known designs.

Having described my invention, however, many modifications thereto will become apparent to those skilled in the art to which it pertains without deviation from the spirit of the invention as defined by the scope of the appended claims.

I claim:

1. A melt tank assembly comprising:

a plurality of cartridges, each cartridge adapted to hold at least one part, an annular tank having an open top adapted to hold heated liquid, a substantially circular plate, said plate having a plurality of circumferentially spaced openings formed around its outer perimeter, each of said openings adapted to slidably receive and support one cartridge, means for rotatably mounting said plate coaxially with said tank so that said outer perimeter of said plate overlies at least a portion of said top of said tank and so that said plate openings register with said tank, means for rotatably driving said plate, means for selectively lifting said cartridges to enable removal and insertion of parts into said cartridges.

2. The invention as defined in claim 1 wherein said rotatable mounting means comprises a pair of vertically extending upright supports at diametrically opposed positions around said tank, a crossbeam extending between said upright supports and above said plate, a motor supported by said crossbeam, said motor having an output shaft, and means for drivingly connecting said motor output shaft to said plate.

3. The invention as defined in claim 1 wherein said rotatable mounting means further comprises means for rotatably mounting said plate to an upper surface of said tank.

4. The invention as defined in claim 1 and comprising means in said tank for collecting molten casting material.

5. The invention as defined in claim 4 wherein said collecting means comprises a trough positioned along the bottom of said tank.

6. The invention as defined in claim 1 and comprising a tilt housing defining a tilt chamber, said tilt housing being positioned at a circumferential position of said tank such that said tilt chamber is fluidly open to said tank, means for selectively moving a cartridge in said tank and aligned with said tilt chamber between said tilt chamber and said tank, and means for temporarily inverting a cartridge positioned in said tilt chamber.

7. The invention as defined in claim 6 and comprising means for radially slidably mounting said cartridges to said plate.

* * * * *